United States Patent [19]

Van Slooten

[11] 4,216,581

[45] Aug. 12, 1980

[54] HAIR CUTTING APPLIANCE

[76] Inventor: Kevin D. Van Slooten, Rte. 2, Box 34, Hettinger, N. Dak. 58639

[21] Appl. No.: 36,340

[22] Filed: May 7, 1979

[51] Int. Cl.[3] ..... B26B 19/44

[52] U.S. Cl. ..... 30/133

[58] Field of Search ..... 30/133, 201

[56] References Cited

U.S. PATENT DOCUMENTS

| | | | |
|---|---|---|---|
| 3,353,265 | 11/1967 | Mendoza | 30/133 |
| 3,654,699 | 4/1972 | Garcia | 30/133 |
| 3,979,825 | 9/1976 | Baumann | 30/133 |
| 4,030,196 | 6/1977 | Koiwa et al. | 30/133 |
| 4,150,483 | 4/1979 | Kanazawa | 30/133 |

*Primary Examiner*—Jimmy C. Peters

*Attorney, Agent, or Firm*—Kinney, Lange, Braddock, Westman and Fairbairn

[57] ABSTRACT

A hair cutting appliance includes a hair handling and vacuuming device having a hair passageway extending through the device from a forward intake portion to a rearward exhaust portion thereof. A barber's shear is positioned fixedly with respect to the device to have its cutting teeth disposed transversely of an intermediate portion of the hair passageway. A vacuum cleaner hose is attached to the rearward portion of the hair handling device. The hair handling device includes a first inclined hair ramp disposed between a forward edge of the forward portion of the device and the barber's shear cutting teeth, the interior end of this ramp terminating adjacent to but forwardly of the shear cutting teeth. A second inclined hair ramp is disposed between the forward edge of the forward portion of the hair handling device, and an interior end of this second ramp terminates in parallel spaced relation to the interior end of the first ramp and in spaced relation to and in alignment with the cutting teeth of the shear blades of the barber's shear. A paddle wheel is mounted inside of the passageway to have paddles which pass from closely adjacent the interior end of the second ramp to closely adjacent the cutting teeth to carry hair passing between the interior ends of the ramps into the cutting teeth. A plurality of hair length determining sleeves of various lengths are provided to be attached to the forward portion of the hair handling device to be placed in contact with the scalp of a customer to receive a haircut, thus determining and fixing the minimum distance between the shear blades and the scalp.

4 Claims, 5 Drawing Figures

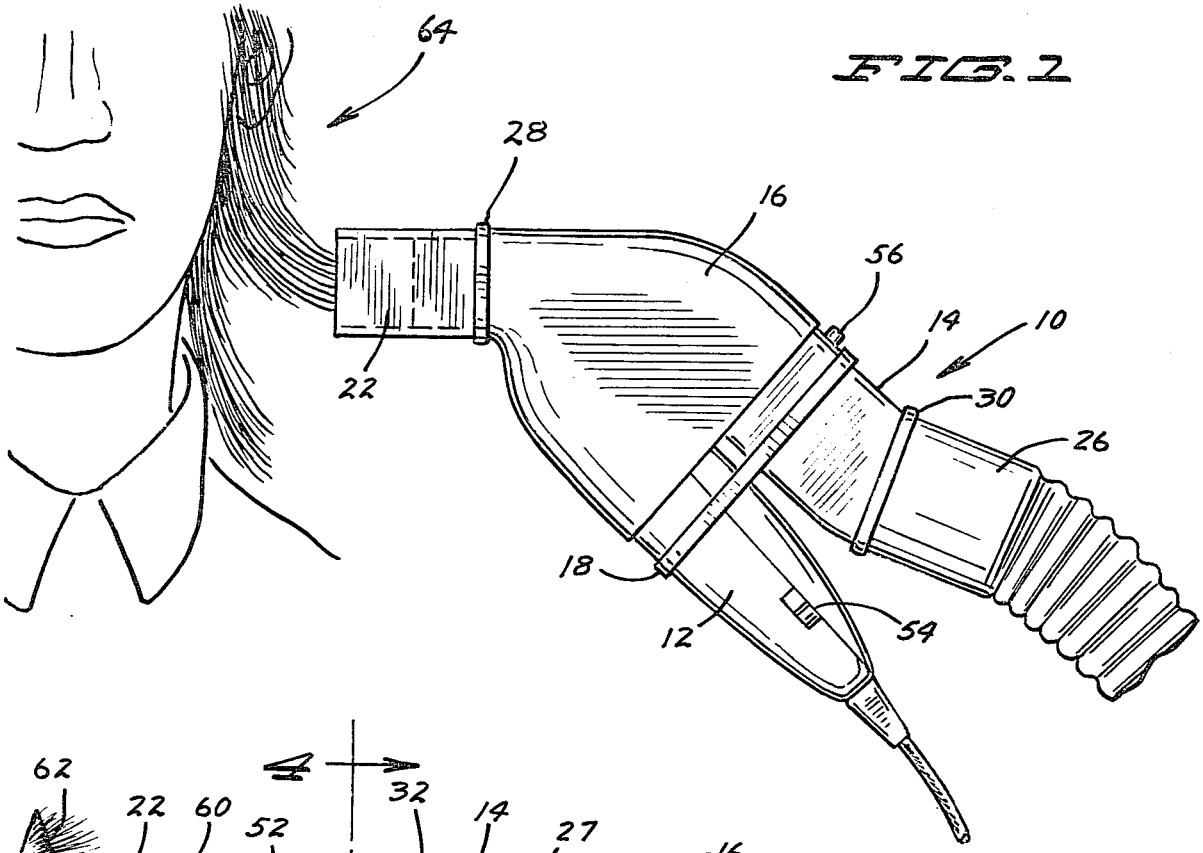
FIG. 1
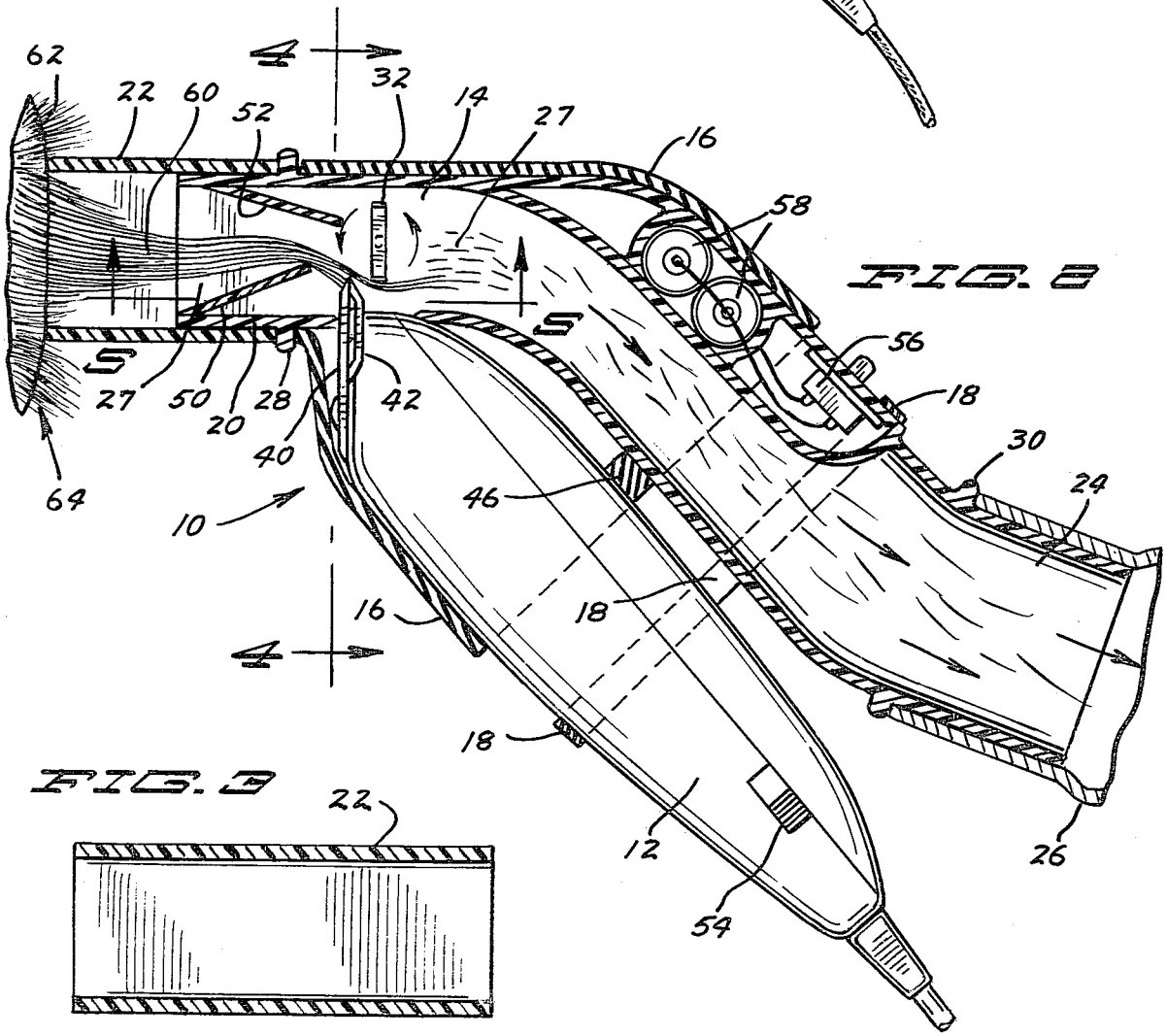
FIG. 2
FIG. 3

HAIR CUTTING APPLIANCE

BACKGROUND OF THE INVENTION

This invention has relation to hair cutting appliances for automatically cutting substantially all of the hair extending from the head of a customer to a uniform length and for automatically disposing of the cut-off hair ends by use of a vacuum.

It is known to use a suction tube to extend the hair from the scalp for the purpose of cutting it at a desired length. See U.S. Pat. No. 1,331,218 to Severson, granted in February of 1920; U.S. Pat. No. 4,000,562 to Alevras, granted in January of 1977; U.S. Pat. No. 4,005,526 to Clay, granted in February of 1977; and U.S. Pat. No. 4,030,196 to Koiwa et al, granted in June of 1977.

In the patent to Severson, a vacuum is applied to cause the hair to be drawn up against reciprocating shear blades within a casing. A gauge foot is provided to position the shear blades a desired distance from the scalp. A space is provided between the tips of the shear blades and the casing so that some of the hair can pass between the shear blades and the casing, and this hair is severed by the shear blades as the appliance is moved along. This structure, patented in 1920, has never found acceptance. Most of the hair drawn into the casing will hit against the back of the shear blades and will not pass between them and the casing so that a tangle will develop, and the appliance will have to be used at a very slow speed indeed to keep the hair on the back of the shear blade from being pinched and caught and then pulled out by the roots to the great discomfort of the customer. Further, there is no positive means of inducing the hair shafts which do pass between the shear blades and the casing to move between the tips of the blades to be severed. Instead, the mass of hair caught behind the shear blades will tend to keep the hair shafts passing up into the casing from getting back to position where they can be sheared by the blades.

The patent to Alevras discloses a casing to which a vacuum is applied to stand the hair on end straight away from the scalp, and slots are provided at intervals along the casing to allow scissors to be used to clip off the hair. This is obviously a painstaking and laborious method of cutting the hair, and because of the presence of the slots, there will be no effective suction to hold the cut hair shafts away from the scalp. These hair shafts will tend to fall back toward the scalp and impede the progress of adjacent uncut hair shafts to find their position in the casing so that they too can be cut. It would appear from the disclosure of the invention, that the casing must be completely removed from the hair each time and then brought back in order to pick up and position those uncut shafts which will be the only shafts to feel the full effect of the suction.

In the patent to Clay, a razor blade is brought down against the hair which is held in position away from the head by a vacuum tube 12. The vacuum tube and razor are positioned a desired distance away from the scalp by a graduated rule 23. The patent recites that the hair is cut off by moving the razor blade across the end of the vacuum tube. This device suffers from the deficiency that there is no positive vacuum action on the portion of the hair shafts from the scalp to the end of the vacuum tube. Thus as soon as a hair shaft is cut to the desired length, it will tend to fall back toward the scalp thus tending to impede the progress of other uncut hair shafts toward and into the vacuum tube. Further, as the razor blade comes across the end of the tube, the vacuum is cut off, thus insuring that the cut hair shafts fall back toward the scalp to impede the operation of the device. Here again, it would appear that the vacuum tube cannot be moved smoothly along the scalp for continuous operation but must be withdrawn from the vicinity of the scalp and moved back toward it again to try to pick up hair which will not feel an effective suction from a tube positioned from 1" to 2" away from the scalp.

The necessarily intermittent operation of the structure of the Clay and Alevras patents renders them incapable of accomplishing the purpose of the present invention.

The patent to Koiwa et al discloses a typical razor cutcomb device in conjunction with a vacuum attachment to remove cut hair particles. The device must be moved forward to cut and backward to reposition the razor with respect to the hair many, many times in order to achieve the desired effect. Each time the device is moved forward, the hair shafts pass between the teeth of a comb to properly position them so they can be effectively cut off by the razor blade or "cutting edge 22". As seen or suggested in FIGS. 1, 3 and 4 of the Koiwa et al patent, the positioning or angle of attack of the cutting edge or razor blade can be changed to determine the minimum length of hair to be cut, but there is no positive means, other than the suction, to shear off the hair ends by continuous action while passing the device across the scalp. This patent disclosure does not contemplate the combination of vacuum with the action of a barber's shear.

The general idea of attaching a vacuum cleaner hose to a barber's shear is shown in U.S. Pat. No. 3,295,200 to Padgett et al, granted in January of 1967. This disclosure contemplates the use of a barber's shear in the regular manner, but provides a nearby suction point to carry cut hair particles away. It only demonstrates the broad concept of disposing of cut hair particles as they are cut, which concept is also disclosed in the Severson patent.

The patents discussed above were discovered in a preliminary search of the prior art. Applicant and those in privity with him know of no closer art and know of no art which anticipates the claims presented herewith.

BRIEF SUMMARY OF THE INVENTION

A hair cutting appliance includes a hair handling and vacuuming device provided with a continuous, substantially imperforate hair passageway therethrough. Vacuum producing means is connected to a first rearward end of this device to cause hair shafts of a customer's head to be drawn into the passageway. A hair length determining sleeve can be positioned on a second forward end of the device, and reciprocating shear blades are positioned within the hair passageway at a fixed distance from the forward end of the device.

At least one rotating paddle is provided within the hair passageway to carry hair shafts extending past the shear blades down into engagement with the teeth of the shear blades to cause these hair shafts to be severed.

A pair of oppositely disposed hair ramps are situated in the hair passageway between the forward end thereof and the shear blade and are in position to cause the hair drawn into the passageway to pass beyond the leading edges of the teeth of the shear blades and within the range of the rotating paddle.

A plurality of hair length determining sleeves of various lengths are provided for insertion on the forward portion of the hair handling and vacuuming device to allow for positioning of the shear blades at any one of a number of desired distances from the scalp when the scalp is in contact with a forward edge of such sleeve.

IN THE DRAWINGS

FIG. 1 is a side elevational view of a hair cutting appliance made according to the invention showing its relationship to the hair and head of a person as the appliance is moved into position to accomplish a haircut;

FIG. 2 is a vertical sectional view of the appliance of FIG. 1 in position and in use to cut hair;

FIG. 3 is a vertical sectional view through a hair length determining sleeve for cutting hair at a longer length than the sleeve seen in FIG. 2.

DESCRIPTION OF PREFERRED EMBODIMENT

Figure 4:
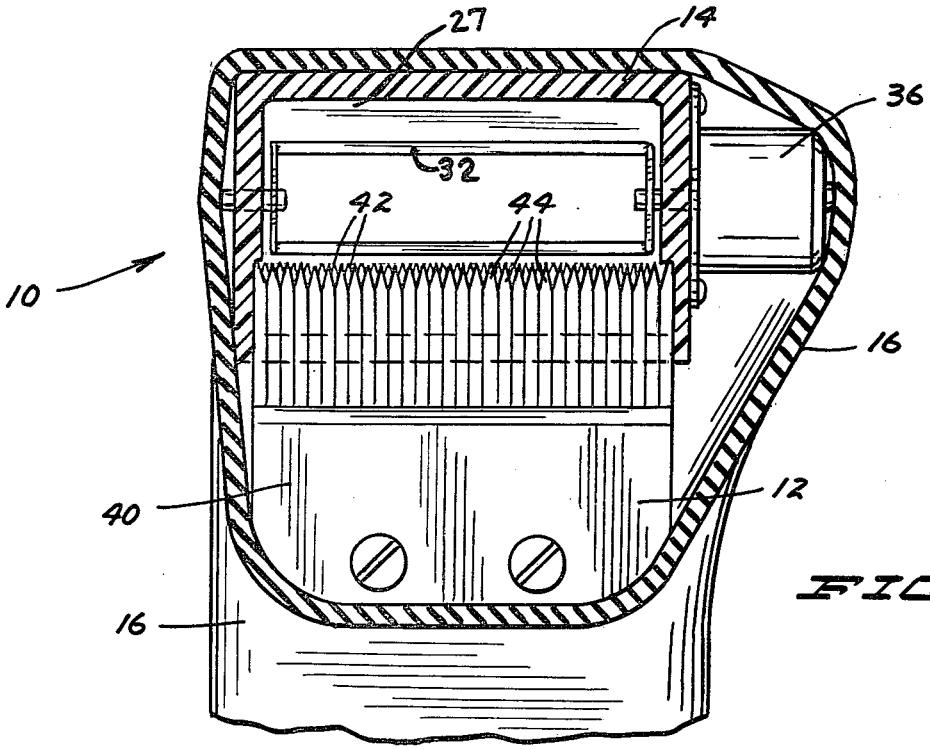
FIG. 4 is an enlarged vertical sectional view taken on the line 4—4 in FIG. 2.

A hair cutting appliance 10 includes a more or less standard barber's shear 12 combined with a hair handling and vacuuming device 14. This appliance and this device are firmly and fixedly positioned with respect to each other by a resilient sleeve 16 and a resilient band 18. The hair handling device 14 includes a nose or intake portion 20 over which can be slid one or another of a plurality of hair length determining sleeves 22 of various lengths. An exhaust or tail portion 24 of the hair handling and vacuuming device 14 is connected to a flexible hose 26 leading to a vacuum cleaner (not shown). A hair passageway 27 is provided through the nose portion, the body of the hair handling device 14 and the tail portion thereof.

A nose flange 28 extends outwardly from the hair handling device 14 to separate the nose portion 20 from the rest of the device and to serve as a positive limit and positioning member for each of the various hair length sleeves 22 which can be frictionally held on said nose portion.

A tail flange 30 similarly forms a limit for the positioning of the flexible hose 26 on the tail portion 24, but this positioning is in no way critical.

Figure 5:
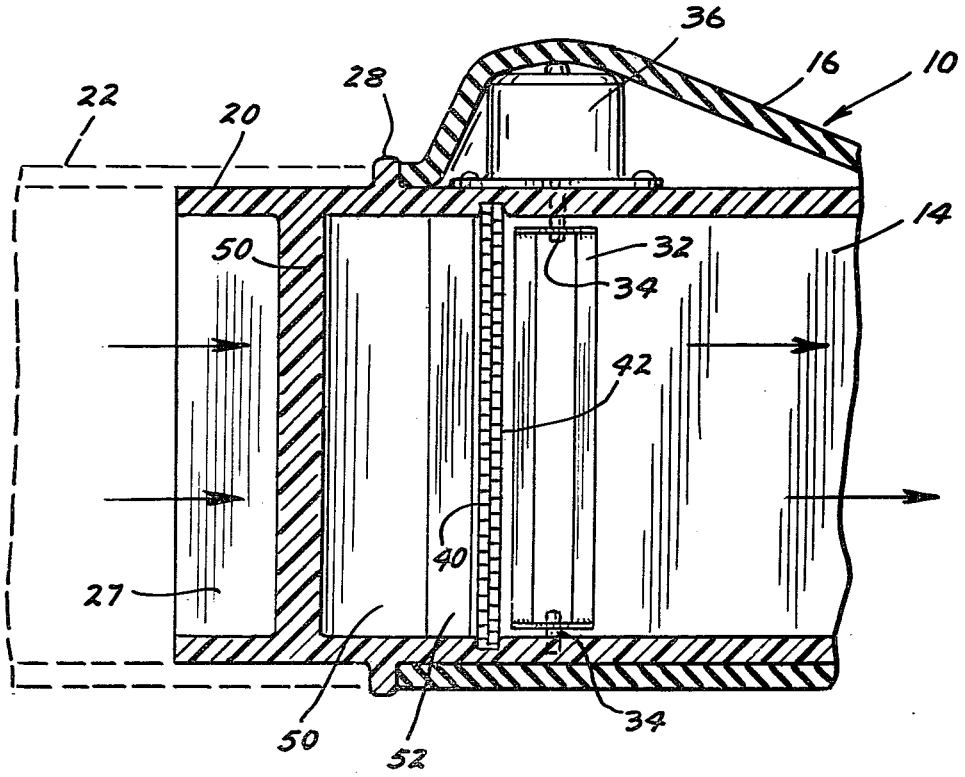
FIG. 5 is an enlarged horizontal sectional view taken on the line 5—5 in FIG. 2.

As seen in FIGS. 2, 4 and 5, a paddle wheel 32 is rotatably mounted in the side walls of the interior of the hair handling and vacuuming device 14 as at 34,34. An electric motor 36 permanently mounted outside of the hair passageway 27 drives the paddle wheel 32 in counterclockwise direction as seen in FIG. 2, in the form of the invention shown. Rotational speeds of the paddle wheel can be varied in accordance with the amount of suction and the speed with which the operator is moving the appliance over the head of the customer, but speeds of 50 to 60 revolutions per minute have given good results.

The barber's shear, in the form of the invention shown, includes cutting blades 40 and 42, one of which is stationary with respect to the body or case of the barber's shear and the other of which reciprocates to cut off all hair shafts which come between the teeth 44 of these blades while the blades are in operation.

In the form of the invention as shown, the resilient sleeve 16 fixedly positions the shear 12 with respect to the hair handling device 14 by holding the shear cutting blade tightly against an opening provided in the case of the hair handling device and by holding the case of the shear firmly against that opening, all as best seen in FIG. 2. Also serving to fixedly position the shear and the hair handling device with respect to each other is a spacer 46 between these entities and the aforementioned resilient band 18 which serves, among other things, to hold the casings of the shear and the hair handling device against the spacer.

A lower hair ramp 50 is fixedly positioned as part of the inside of the hair handling device 14 transversely of the hair passageway 27 and is for the purpose of assuring that the hair entering this hair handling device and the hair passageway thereof enters above the level of the tips of the teeth 44 of the cutting blades 40 and 42.

An upper hair ramp 52 also is permanently positioned as a part of the interior of the hair handling device 14 and is for the purpose of assuring that the hair passing over the top of the cutting blades 40 and 42 is held below the uppermost position of the paddles of the paddle wheel 32.

The size and positioning of paddle wheel 32 is such that it will just clear the edge of the upper hair ramp 51 and the top tips of the teeth 44 of the cutting blades 40 and 42.

OPERATION

Once the barber and the customer determine the uniform length to which the customer's hair is to be trimmed or cut, the appropriate hair length determining sleeve 22 is selected and slid onto the nose portion 20 of the hair handling device 14 to assume the position as seen in FIGS. 1 and 2. The length of each hair, when the haircut is finished, will be the distance from the customer's scalp in contact with the outer edge of the particular hair length determining sleeve to the surface between the teeth 44 of cutting blades 42 and 40.

To utilize the hair cutting appliance 10 of the invention, the vacuum cleaner (not shown) will be activated to provide a suction in the tail or exhaust portion 24 of the hair handling device. A barber's shear activating switch 54 will be turned to the "on" position to activate the cutting or shear blades 40 and 42 of the barber's shears. A paddle wheel activating switch 56 will be turned "on" to cause an appropriate electrical circuit (not shown) and batteries 58,58 to activate paddle wheel motor 36 to cause the paddle wheel 32 to rotate in a counterclockwise direction as seen in FIG. 2.

In order to better illustrate and describe the action of the appliance of the invention, a single tuft of hair 60 is shown extending from a fragmentary view of a portion of a head or scalp 62 of a customer such as customer 64.

In actuality, as the hair cutting appliance 10 is moved into operating position against the scalp of the customer from the position as shown in FIG. 1 to the position as shown in FIG. 2, for example, the entire space between the side walls of the hair passageway 27 in the opening of nose portion 20 will be filled with hair between the lower edge of the upper hair ramp 52 and the upper edge of the lower hair ramp 50. As soon as any shaft of that hair comes between the teeth of the cutting blades 40 and 42, it is severed, and it proceeds back out of flexible vacuum cleaner hose 26 to the vacuum cleaner. Considering only the tuft 60, as each of the paddles of the paddle wheel 32 comes around on the left side of its stroke as seen in FIG. 2, it will carry all of the hair extending beyond the outer edges of the hair ramps down into position between the teeth of the cutting blades. Virtually all of the hair shafts will be brought between the teeth because the paddles pass immediately adjacent to the teeth. Any individual shaft which would escape as the paddle carries it down, because of some slight spacing between the moving paddle wheel and the vibrating teeth, will be brought down and severed as the next paddle comes around on its stroke and as the appliance is moved in upward direction with respect to the scalp.

This positive action of the paddles in carrying the hair shafts into position between the vibrating teeth insures a substantially absolutely uniform hair length over those portions of the scalp where the outer edge of the hair length determining sleeve 22 is kept in contact with the scalp or with the hair immediately adjacent to the scalp.

The embodiments of the invention in which an exclusive property or privilege is claimed are defined as follows:

1. A hair cutting appliance for use with a means for drawing a vacuum, said appliance being useful to cut a customer's hair to uniform minimum length, and said appliance including:

A. a hair handling device having a forward intake portion and a rearward exhaust portion, said device being provided with a substantially imperforate hair passageway extending through the device from the intake to the exhuast portion;

B. a hair cutting shear having a plurality of generally linearly disposed shear blade cutting teeth;

C. means for fixedly positioning the shear with respect to the hair handling device to dispose the line of cutting teeth transversely of the hair passageway in adjacent spaced relation to a forward end of the intake portion of the hair handling device, and inside of the hair passageway;

D. said hair handling device including:

(1) a first inclined hair ramp disposed between a forward edge of the intake portion of the hair handling device and said shear blade cutting teeth, an interior end of said ramp terminating adjacent to, forwardly of and short of said cutting teeth, and (2) a second inclined hair ramp disposed between a forward edge of said intake portion and said shear blade cutting teeth, said ramp being disposed in generally opposite, spaced apart, opposed relation to said first ramp, an interior end of said second ramp terminating in spaced relation to and outwardly from said cutting teeth; and E. means for attaching said means for drawing a vacuum onto said exhaust portion of said hair handling device.

2. The hair cutting appliance of claim 1 wherein:

F. means is provided inside said hair passageway of said hair handling device for carrying hair passing between said ramps into said shear blade cutting teeth, said means including:

(1) a paddle wheel rotatably mounted in said hair passageway to have at least one paddle positioned to pass repeatedly from closely adjacent relation to said terminal interior end of said second ramp to closely adjacent relation to said cutting teeth, and (2) means to cause said paddle wheel to rotate.

3. The hair cutting appliance of claim 1 wherein:

F. said hair cutting appliance includes a plurality of hair length determining sleeves of various lengths, each such sleeve being hollow and of size and shape to be temporarily affixed at a first end thereof to the intake portion of said hair handling device and shaped at a second end thereof to contact the scalp of a customer to fix the minimum distance between the scalp and the shear blade cutting teeth, each sleeve being substantially imperforate to cause all hair aligned with the sleeve between the scalp and the cutting blades to be subjected to full available vacuum action.

4. The hair cutting appliance of claim 2 wherein:

G. said hair cutting appliance includes a plurality of hair length determining sleeves of various lengths, each such sleeve being hollow and of size and shape to be temporarily affixed at a first end thereof to the intake portion of said hair handling device and shaped at a second end thereof to contact the scalp of a customer to fix the minimum distance between the scalp and the shear blade cutting teeth, each sleeve being substantially imperforate to cause all hair aligned with the sleeve between the scalp and the cutting blades to be subjected to full available vacuum action.

* * * * *